United States Patent [19]

Davis

[11] 4,348,633

[45] Sep. 7, 1982

[54] BANDGAP VOLTAGE REGULATOR HAVING LOW OUTPUT IMPEDANCE AND WIDE BANDWIDTH

[75] Inventor: William F. Davis, Tempe, Ariz.

[73] Assignee: Motorola, Inc., Schaumburg, Ill.

[21] Appl. No.: 276,147

[22] Filed: Jun. 22, 1981

[51] Int. Cl.[3] ..... G05F 3/20

[52] U.S. Cl. ..... 323/314; 323/907; 307/310; 330/256

[58] Field of Search ..... 323/313–316, 323/907; 307/296 R, 297, 310; 330/256, 257, 288, 289, 296, 297

[56] References Cited

U.S. PATENT DOCUMENTS

| | | | |
|---|---|---|---|
| 3,617,859 | 11/1971 | Dobkin | 323/313 |
| 3,886,435 | 5/1975 | Steckler | 323/907 X |
| 3,887,863 | 6/1975 | Brokaw | 323/314 |
| 4,238,738 | 12/1980 | Komori | 330/256 |
| 4,249,122 | 12/1981 | Widlar | 323/313 |
| 4,263,519 | 4/1981 | Schade, Jr. | 323/314 X |

*Primary Examiner*—William M. Shoop
*Assistant Examiner*—Peter S. Wong
*Attorney, Agent, or Firm*—Vincent B. Ingrassia

[57] ABSTRACT

In a solid state temperature compensated voltage supply, a differentially coupled pair of transistors is employed to produce a first voltage having a negative temperature coefficient utilizing a unity gain negative feedback amplifier configuration. Means are provided for producing an adjustable voltage having a positive TC across an output resistor coupled to the output of the unity gain feedback amplifier which when added to the negative temperature coefficient voltage produces a net output voltage which has a zero temperature coefficient, low output impedance and high bandwidth independent of operating voltage.

8 Claims, 1 Drawing Figure

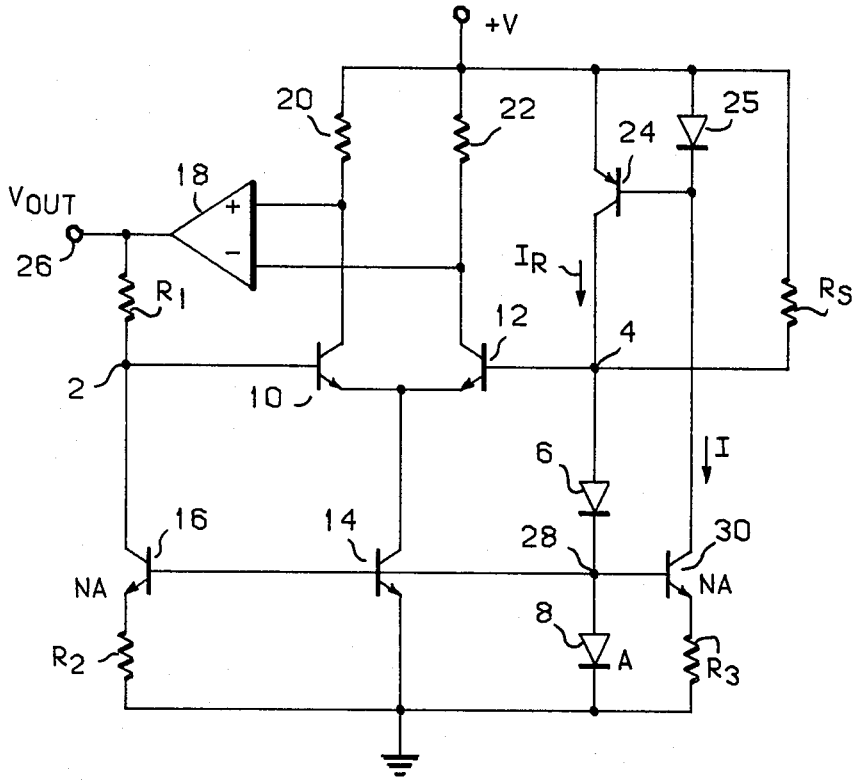
+V
20
22
24
25
18
VOUT
26
R1
IR
RS
12
4
2
10
6
I
16
14
28
30
NA
NA
8
A
R2
R3

BANDGAP VOLTAGE REGULATOR HAVING LOW OUTPUT IMPEDANCE AND WIDE BANDWIDTH

BACKGROUND OF THE INVENTION

1. Field of the Invention

This invention relates generally to a regulated DC voltage supply, and more particularly, to a solid state integrated circuit voltage regulator capable of maintaining a substantially constant DC output voltage in the face of temperature variations while exhibiting a low output impedance.

2. Description of the Prior Art

In prior art transistorized voltage regulator circuits, the reference source is typically provided by a zener diode. As is well known, however, zener diodes have inherent characteristics which undesirably restrict the capability of a voltage regulator. An alternate form of solid state regulator which does not utilize a zener diode reference relies, instead, on the temperature dependent characteristics of the base-to-emitter voltage ($V_{BE}$) of a transistor. Such an arrangement is shown and described in U.S. Pat. No. 3,617,859. This arrangement, however, suffers from certain serious limitations.

The concept upon which any bandgap reference is based resides in the addition of a $\Delta V_{BE}$ voltage having a positive temperature coefficient to a $V_{BE}$ having a negative temperature coefficient. The expression for the output voltage in the above cited patent is $$V_{OUT}=(kTR_2/qR_1)\ \ln\ (I_R/I_O)+V_{BE}$$

where k is Boltzman constant, T is the absolute temperature, q is the charge on an electron, $R_1$ and $R_2$ are first and second resistors, $I_R$ is a reference current, $I_O$ is the output current and $V_{BE}$ is a base-emitter voltage of a transistor having a negative temperature coefficient. Since $I_O$ is generally much smaller than the reference current $I_R$, the expression can be altered to read $$V_{OUT}\cong(kT/q)(R_2/R_1)(C)+V_{BE}$$

where (C) is substantially constant.

That is, the ratio $I_R/I_O$ will be very large if $I_O$ is much smaller than $I_R$ and therefore ln ($I_R/I_O$) will not vary considerably with slight variations in current. It can now be seen that by varying the ratio $R_2/R_1$, a positive temperature coefficient can be introduced to cancel the negative temperature coefficient associated with $V_{BE}$ at which point the output voltage $V_{OUT}$ is substantially equal to the bandgap voltage $E_{GO}$. Not only does the expression yield a $V_{OUT}$ where ln ($I_R/I_O$) varies slightly with current variations, but the circuit exhibits a poor output impedance.

U.S. Pat. No. 3,887,863 entitled "Solid State Regulated Voltage Supply" overcomes many of the limitations and disadvantages associated with prior art regulators. The circuit disclosed in this patent is a solid state integrated circuit regulated voltage supply which compensates for the effects of changes in temperature and includes first and second transistors having different emitter areas. Equal currents are caused to flow through each of the transistors thus creating different current densities in each of the transistors. Associated circuitry developes a voltage proportional to the $\Delta V_{BE}$ of the two transistors and has a positive temperature coefficient. This voltage is connected in series with the $V_{BE}$ voltage of one of the two transistors to produce a resultant voltage with a nearly zero temperature coefficient. A negative feedback circuit responsive to current flow through the two transistors automatically adjusts the base voltages to maintain a predetermined ratio of current density for the two transistors. The positive temperature coefficient current component in this case is $$(kT/qR)\ \ln\ [N(I_1/I_2)]$$

where N represents the emitter area ratio and $I_1$ and $I_2$ are the respective currents flowing through the first and second transistors. Now, since $I_1$ and $I_2$ are equal, the relationship becomes $$(kT/qR)\ \ln N.$$

The natural logrithm term is now clearly a constant. The unity gain feedback output impedance ($R_{OUT}$) is generally equal to $$R_{OUT}=1/gm$$

where gm is the open loop transconductance of the amplifier. The gm of the circuit shown in the above cited patent is generally much lower than a differential type amplifier due to emitter degeneration resistance and thus exhibits poor output impedance in comparison with the differential type. Furthermore, the closed loop output resistance and the high frequency bandwidth deteriorates when resistive dividers are employed to level shift the reference voltage to higher output voltages due to reduction in negative feedback caused by the resistive level shift.

SUMMARY OF THE INVENTION

It is an object of the present invention to provide an improved bandgap voltage regulator having a low output impedance over a wide output voltage range.

It is a further object of the present invention to provide an improved bandgap voltage regulator employing a unity gain differential amplifier in a negative feedback loop yielding higher frequency performance over a wide output voltage range.

It is a still further object of the present invention to provide an improved bandgap voltage regulator which exhibits high frequency unity gain bandwidth, low output impedance and a zero temperature coefficient over a wide range of output voltages.

According to a first aspect of the invention there is provided a solid state voltage supply for generating a temperature compensated voltage at an output node thereof, comprising: first and second emitter coupled differential transistors each having base, emitter and collector terminals, the base of said first transistor adapted to be coupled to a first voltage having a negative temperature coefficient; circuit means coupled to the collectors of said first and second transistors for furnishing a first supply voltage thereto to develop current flow therethrough; current sinking means coupled to the emitters of said first and second transistors; first means responsive to differential currents flowing through said first and second transistors and having an output coupled to said output node; first impedance means having a first terminal coupled to said output node and a second terminal coupled to the base of said second transistor, the voltage at the base of said second transistor being substantially equal to said first voltage during steady state conditions; and second means coupled to said first impedance means for producing a second voltage across said first impedance means having a positive temperature coefficient, said second voltage being added to the voltage at the base of said second transistor to produce said temperature compensated voltage.

BRIEF DESCRIPTION OF THE DRAWINGS

The above and other objects, features and advantages of the present invention will be more clearly understood from the following detailed description taken in conjunction with the accompanying drawing which is a schematic diagram of the inventive bandgap voltage regulator circuit.

DESCRIPTION OF THE PREFERRED EMBODIMENT

Referring to the drawing, a differential transistor pair 10 and 12 have their bases coupled to nodes 2 and 4 respectively and their emitters coupled to the collector of transistor 14. The collectors of differential transistors 10 and 12 are coupled respectively to current source loads 20 and 22. The collector of transistors 10 and 12 are likewise coupled to the non-inverting and inverting inputs of amplifier 18 which has an output coupled to output terminal 26 at which the voltage ($V_{OUT}$) appears. A first resistor $R_1$ is coupled between the output of amplifier 18 and node 2. A transistor 16 having an emitter area NA where N is some positive number preferably greater than one has a collector coupled to node 2 and an emitter coupled to ground via resistor $R_2$. The base of transistor 16 is coupled to the base of transistor 14 which has an emitter coupled to ground. The bases of both transistor 14 and transistor 16 are coupled to a node 28 corresponding to the cathode of diode 6 and the anode of diode 8. The anode of diode 6 is coupled via node 4 to a current mirror including transistor 24 and diode 25. A start resistor $R_S$ is coupled from +V to node 4, and diode 8 having an area A has a cathode coupled to ground. Finally, transistor 30 has a collector coupled to the base of transistor 24 and cathode of diode 25, a base coupled to node 28 and an emitter having area NA coupled via $R_3$ to ground where N is a positive number.

As can be seen, node 4 is coupled to a voltage 2 $V_{BE}$ where $V_{BE}$ is the base-emitter voltage of a transistor or the voltage drop across a diode. The circuit achieves a stable or steady state when the voltage at node 2 is also equal to $2V_{BE}$. If the voltage at node 2 falls below $2V_{BE}$, transistor 10 conducts less and transistor 12 conducts more causing a differential increase at the input of amplifier 18 turning it on harder which will in turn cause the voltage at node 2 to rise. On the other hand, should the voltage at node 2 exceed that at node 4, a differential decrease will occur at the input of amplifier 18 since transistor 10 will conduct more and transistor 12 will conduct less which in turn causes the voltage at node 2 to go down. Therefore, the voltage at node 2 will stabilize at $2V_{BE}$. The high gain unity feedback differential loop provides for a lower output resistance ($R_{OUT}$). Furthermore, the unity gain feedback loop provides higher frequency performance capability; i.e. larger bandwidth.

For reasons described earlier, the voltage appearing at node 2 (i.e. $2V_{BE}$) is a negative temperature coefficient (TC) voltage. To achieve a zero TC output voltage ($V_{OUT}$), a positive temperature coefficient voltage must be developed across resistor $R_1$. The current flowing through diode 8, initiated by $R_S$, causes current I to flow into the collector of transistor 30. This current is mirrored by diode 25 and transistor 24 to produce reference current $I_R$ flowing into node 4 which is also equal to I. Therefore, $$I=(kT/qR_3)\ \ln\ [N(I_R/I)]=(kT/qR_3)\ \ln N$$

The magnitude of these regenerated currents are larger than the initiating current. If transistors 30 and 16 have emitter areas NA and $R_2=R_3$ then current flowing through diodes 6 and 8 is essentially the same as that flowing through transistor 16. Thus, the current flowing through resistor $R_2$ may be expressed as $$(kT/qR_2)\ \ln N.$$

The current flowing through diodes 6 and 8 may be rendered equal to that flowing into transistor 16 even if the emitter areas of transistors 16 and 30 are not equal by properly scaling resistors $R_2$ and $R_3$.

The voltage being developed across resistor $R_1$ may be expressed as $$(kTR_1/qR_2)\ \ln N.$$

This is the positive temperature coefficient component of the output voltage which may finally be expressed as $$V_{OUT}=(kT/q)(R_1/R_2)\ \ln N+2V_{BE}$$

By adjusting the ratio $R_1/R_2$, the negative TC of the $2V_{BE}$ term may be cancelled by the positive TC term to produce a zero TC output. This will occur when the output voltage is twice the bandgap voltage or $2E_{GO}$.

It should be appreciated that the base of transistor 12 (node 4) need not necessarily be tied to a voltage equal to $2V_{BE}$. It may be tied to any negative TC voltage (including an $nV_{BE}$ negative TC component) which may be cancelled by properly ratioing $R_1/R_2$ and still achieve a zero TC high frequency low output impedance circuit since the output impedance is always produced by a unity gain feedback differential amplifier independent of the voltage on node 4. This is not true of the arrangement taught in U.S. Pat. No. 3,887,863 since the feedback of that circuit decreases at higher voltages.

The above description is given by way of example only. Changes in forms and details may be made by one skilled in the art without departing from the scope of the invention.

I claim:

1. A solid state voltage supply for generating a temperature compensated voltage at an output node thereof, comprising:

first and second emitter coupled differential transistors each having base, emitter and collector terminals, the base of said first transistor adapted to be coupled to a first voltage having a negative temperature coefficient;

circuit means coupled to the collectors of said first and second transistors for furnishing a first supply voltage thereto to develop current flow therethrough;

current sinking means coupled to the emitters of said first and second transistors;

first means responsive to differential currents flowing through said first and second transistors and having an output coupled to said output node;

first impedance means having a first terminal coupled to said output node and a second terminal coupled to the base of said second transistor, the voltage at the base of said second transistor being substantially equal to said first voltage during steady state conditions; and second means coupled to said first impedance means for producing a second voltage across said first impedance means having a positive temperature coefficient, said second voltage being added to the voltage at the base of said second transistor to produce said temperature compensated voltage.

2. A solid state, temperature compensated voltage supply according to claim 1 wherein said first means comprises a differential to single ended converter.

3. A solid state temperature compensated voltage supply according to claim 2 wherein said second means comprises:

a third transistor having a collector coupled to the base of said second transistor and having a base and an emitter;

second impedance means coupled to the emitter of said third transistor and adapted to be coupled to a second supply voltage;

first diode means coupled between the base of said first transistor and the base of said third transistor;

second diode means coupled to the base of said third transistor and adapted to be coupled to said second supply voltage, the voltage across said first impedance means being directly proportional to the ratio of the impedance of said first impedance means to the impedance of said second impedance means;

third impedance means;

a fourth transistor having a base coupled between said first and second diode means, an emitter adapted to be coupled to said second supply voltage via said third impedance means; and current mirror means coupled between the collector of said fourth transistor and the base of said first transistor.

4. A solid state temperature compensated voltage supply according to claim 3 wherein said first, second and third impedance means are resistors.

5. A solid state temperature compensated voltage supply according to claim 4 wherein the emitters of said third and fourth transistors each have an emitter area NA where N is positive number greater than one.

6. A solid state temperature compensated voltage supply according to claim 5 wherein said second and third impedance means are resistors of equal value.

7. A solid state temperature compensated voltage supply according to claim 6 wherein said current sinking means comprises a fifth transistor having a base coupled to the bases of said third and fourth transistors, a collector coupled to the emitters of said first and second transistors and having an emitter adapted to be coupled to said second supply voltage.

8. A solid state temperature compensated voltage supply according to claim 7 wherein said first, second, third, fourth and fifth transistors are NPN transistors.

* * * * *